United States Patent [19]

Kotas et al.

[11] 4,025,029

[45] May 24, 1977

[54] HAMMER-ACTIVATED POWDER-ACTUATED FASTENING TOOL

[75] Inventors: John A. Kotas, Chicago Heights; Eugene J. Haupt, Flossmoor, both of Ill.

[73] Assignee: DESA Industries, Inc.

[22] Filed: Feb. 9, 1976

[21] Appl. No.: 656,615

[52] U.S. Cl. ..... 227/10

[51] Int. Cl.[2] ..... B25C 1/14

[58] Field of Search ..... 227/8, 10, 11

[56] References Cited

UNITED STATES PATENTS

| | | | |
|---|---|---|---|
| 2,768,375 | 10/1956 | Catlin | 227/11 |
| 3,348,751 | 10/1967 | Henning | 227/8 |
| 3,563,439 | 2/1971 | Pomeroy | 227/8 |

*Primary Examiner*—Granville Y. Custer, Jr.

[57] ABSTRACT

A powder-actuated fastening tool is provided with a firing mechanism which permits the powder cartridge to be fired by a hammer. The tool includes an outer housing, a piston guide slidable within the housing, and a piston slidable within the piston guide. An abutment in the housing extends through a slot in the piston guide and is engageable with the piston for moving the piston rearwardly relative to the piston guide to eject a spent cartridge and to position the piston for firing. The cartridge is mounted within a cartridge holder on the end of the piston guide, and the cartridge-firing mechanism is mounted on the end of the housing. The cartridge-firing mechanism includes a guide tube secured to the housing, a bolt slidable within the guide tube, and a spring biasing the bolt away from the cartridge holder. A cartridge in the cartridge holder can be fired by striking the bolt with a hammer with sufficient force to overcome the resistance of the spring and to cause the bolt to strike and fire the cartridge.

16 Claims, 7 Drawing Figures

4
5

HAMMER-ACTIVATED POWDER-ACTUATED FASTENING TOOL

BACKGROUND

This invention relates to a hammer-activated powder-actuated fastening tool. Powder-actuated fastening tools are used for driving fasteners or studs into concrete and other material. Such tools are conventionally of two types — high velocity and low velocity. A low velocity tool includes a piston which is driven by the explosive force of a fired cartridge and drives the fastener into the workpiece, i.e., the material into which the fastener is driven. A high velocity tool does not include a piston, and the fastener is driven directly by the explosive force of the cartridge.

Several low velocity stud drivers are available. One type of low velocity tool is described in U.S. Pat. No. 3,066,302 and includes a means for resetting the piston to its firing position at the rear or breech end of the piston guide. This tool is a pistol-type tool which uses a trigger and sear to trip a spring-loaded firing pin. The firing pin is cocked by pushing the muzzle end of the tool against the workpiece to move the piston guide rearwardly within the tool housing and to compress the spring.

Pistol-type low velocity stud drivers are quite popular, but they are relatively expensive. For this reason hammer-activated stud drivers have been offered. Hammer-activated stud drivers are conventionally operated by placing the muzzle end of the tool against the workpiece and striking the rear end of the tool with a hammer to fire the cartridge. Such tools do not need the trigger and sear mechanisms and are less expensive than the pistol-type stud drivers. However, the relative simplicity of the hammer-activated tools provides certain disadvantages. For example, the tool may be inadvertently drop-fired, i.e., the cartridge may be fired if the tool is accidentally dropped on its rear end. Also, it is generally more difficult to load and unload hammer-activated tools than pistol-type tools. One type of hammer-activated tool is described in co-owned U.S. Pat. No. 2,768,375, but this tool is a high velocity tool. To the best of our knowledge, there is only one low velocity hammer-driven powder-actuated stud driver on the market.

SUMMARY OF THE INVENTION

The invention provides a low velocity hammer-activated powder-actuated fastening tool which is inexpensive yet safe and easy to operate. The tool is loaded merely by sliding the piston guide forwardly within the housing so that a cartridge can be inserted through a breech opening in the housing into a cartridge holder on the rear end of the piston guide. The tool is ready to fire when the piston guide is returned rearwardly to position the cartridge adjacent the firing mechanism. The firing mechanism includes a bolt which is spring-biased away from the cartridge, and the rear end of the bolt is surrounded by a protective shroud to prevent drop-firing and to protect the operator's hand from improperly directed hammer blows. A nut on the bolt can be positioned to provide a desired preset spring force. The tool is fired by striking the bolt with sufficient force to overcome the force of the spring and to drive the bolt against the cartridge. The explosive force of the cartridge drives the piston forwardly within the piston guide. The piston is returned to the rear of the piston guide by moving the piston guide forwardly within the housing, forward movement of the piston being prevented by an abutment in the housing which extends through a slot in the piston guide. A cartridge ejector pin on the rear end of the piston ejects the spent cartridge from the cartridge holder when the piston is reset, and the cartridge is free to fall from the housing through the breech opening. The piston is provided with a friction ring to maintain the piston in a ready-to-fire position, but the piston is free to move forward slightly from its cartridge-ejecting position to permit a new cartridge to be inserted.

DESCRIPTION OF THE DRAWING

The invention will be explained in conjunction with an illustrative embodiment shown in the accompanying drawing, in which.

DESCRIPTION OF SPECIFIC EMBODIMENT

Figures 1, 2, 3:
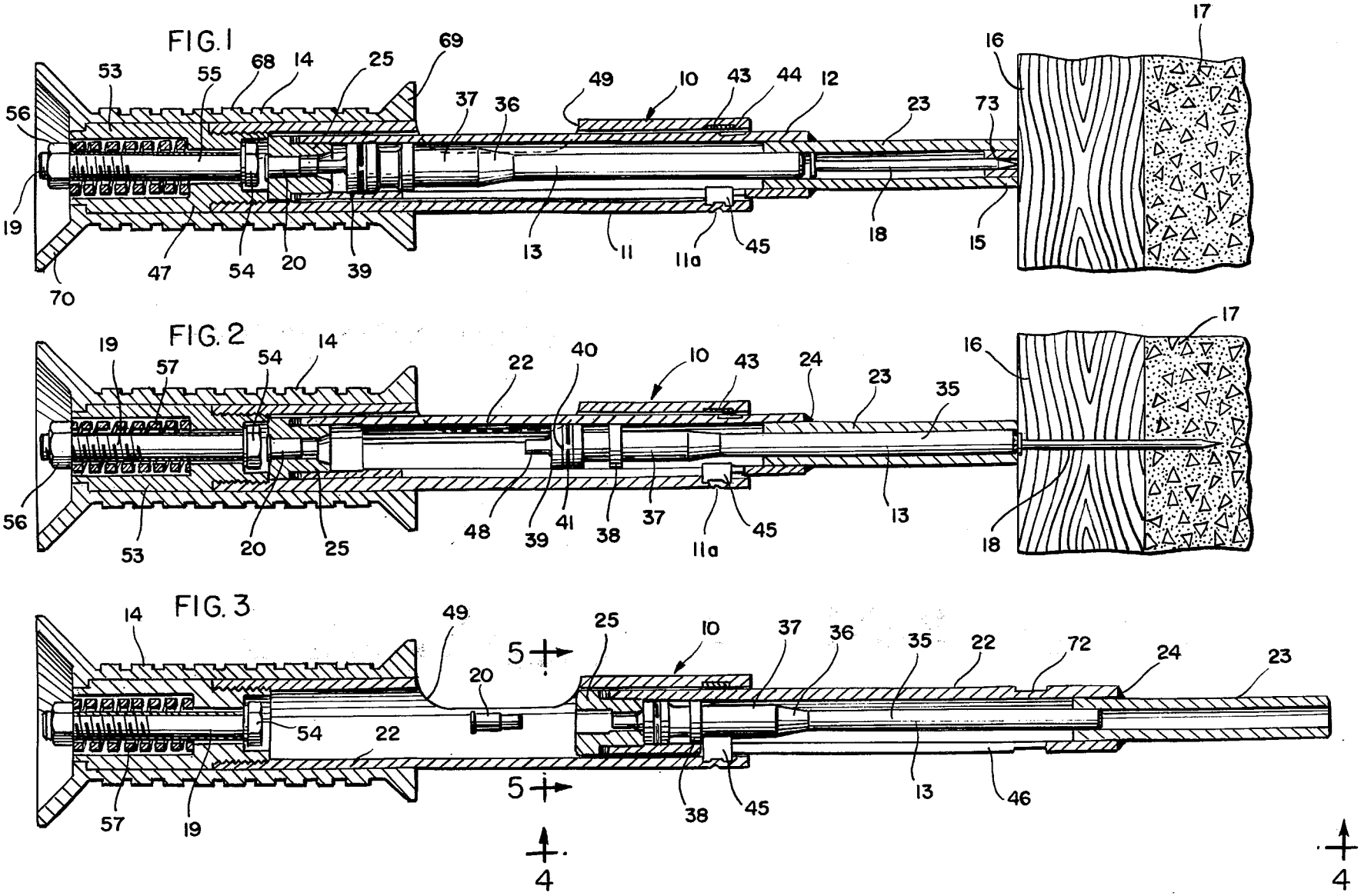
FIG. 1 is a longitudinal sectional view of a fastening tool formed in accordance with the invention, the tool being shown in a ready-to-fire position.
FIG. 2 is a view similar to FIG. 1 showing the tool after it has been fired.
FIG. 3 is illustrating the piston guide moved forwardly to reset the piston and to eject the cartridge.

Referring to FIGS. 1–3, the numeral 10 designates generally a hammer-activated powder-actuated fastening tool which includes an outer cylindrical tubular housing 11, a cylindrical tubular piston guide 12 which is reciprocable within the housing, and a piston 13 which is reciprocable within the piston guide. A flanged gripping handle 14 is secured to the rear end of the tool, and the tool is operated by grasping the tool around the grip 14 with one hand and pressing the muzzle or forward end 15 of the tool against a workpiece 16. In the illustration given, the workpiece 16 is a piece of wood which is to be secured to a concrete support 17 by a nail or stud 18 which is positioned within the muzzle end of the tool. A firing pin 19 at the rear end of the tool is struck with a hammer to drive the firing pin against a powder cartridge 20 with sufficient force to fire the cartridge. The explosive force of the cartridge propels the piston 13 forwardly to drive the fastener 18 into the workpiece as illustrated in FIG. 2.

The piston guide 12 includes a cylindrical metal tube 22 which slides within the housing 11 and a muzzle tube 23 of smaller diameter which is positioned within the tube 22 and secured thereto as by weld 24 or some other mechanical engagement, such as threads. A generally cylindrical cartridge-mounting plug or holder 25 is secured to the rear end of the guide tube 22 and is provided with a central bore 26 (FIG. 6) for receiving the cartridge 20. The cartridge holder includes an inner portion 27 having an outside diameter such that the inner portion is snugly received within the guide tube 22 and an outer portion 28 having an outer diameter approximately the same as the outer diameter of the tube 22. In the embodiment illustrated the holder is secured to the tube 22 by a weld 29 or some other mechanical engagement. The bore of the cartridge holder includes three portions of different diameters which are sized to accommodate the different sized portions of the cartridge. The bore includes a rim portion 30, a central portion 31 of slightly smaller diameter, and a forward portion 32 of still smaller diameter which merges with a flared forward end 33.

The piston 13 is formed integrally from hardened metal and includes an elongated forward portion 35 having a diameter substantially the same as the inside diameter of the muzzle portion 23 of the piston guide, a frusto-conical portion 36, and a rear portion 37 of slightly larger diameter than the forward portion 35. A pair of axially spaced guide rings 38 and 39 extend radially outwardly from the rear portion 37 and have an outer diameter substantially the same as the inside diameter of the guide tube 22. The rear ring 39 has an axial dimension slightly greater than the front ring 38 and is provided with an annular groove 40 which receives a resilient split ring 41. The ring 41 has a normal outside diameter greater than the inside diameter of the guide tube 22, and when the ring and piston are positioned within the guide tube 22, the ring is compressed slightly by the tube. The separated ends of the split ring move toward each other to accommodate this compression. As will be described more fully hereinafter, the ring 40 exerts a frictional force against the wall of the guide tube 22 to maintain the piston in a ready-to-fire position.

Figure 7:
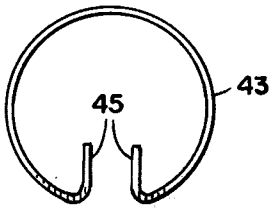
FIG. 7 is an enlarged plan view of the abutment spring.

An abutment ring 43 is positioned within an annular recess 44 in the forward end of the outer housing 11 and includes a pair of separated inwardly turned end portions 45 (see also FIG. 7) which extend radially inwardly through an elongated axially extending slot 46 (see FIGS. 3 and 4) in the guide tube 22 of the piston guide. The inwardly turned ends 45 of the abutment ring extend through the slot 46 a sufficient distance to engage the front shoulder of the front ring 38 of the piston. The annular recess 44 in which the abutment ring is positioned secures the ring against axial movement within the housing 11, and the inwardly turned ends 45 prevent forward movement of the ring 38 of the piston beyond the abutment ring. The housing is indented inwardly at 11*a* between the end portions 45 of the abutment ring to prevent rotation of the abutment ring and the piston guide within the housing.

Figure 5:
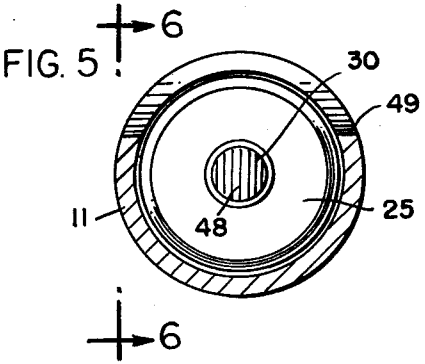
FIG. 5 is a sectional view taken along the line 5—5 of FIG. 3.

The piston and piston guide are shown in their retracted or ready-to-fire positions in FIG. 1. The piston guide is retracted within the housing against the firing mechanism designated generally by the numeral 47, and the piston is retracted within the piston guide so that the rear ring 39 of the piston is adjacent the cartridge holder 25. The tool is shown in FIG. 2 after it has been fired. The piston guide 22 remains in its retracted position, but the piston has been driven forwardly by the cartridge to drive the fastener 18 into the workpiece. The piston can thereafter be returned to its ready-to-fire position within the piston guide by causing the piston guide to move axially forwardly within the housing. This can be done by grasping the muzzle portion 23 of the piston guide or by snapping the forward end of the tool with a flick of the wrist while the tool is being held by the grip 14. As the piston guide moves forwardly within the housing, the frictional force created by the split ring 41 on the piston will cause the piston to move with the piston guide until the forward ring 38 on the piston engages the inwardly turned ends 45 of the abutment ring. Continued forward movement of the piston relative to the housing is thereafter prevented, and continued forward movement of the piston guide will move the cartridge holder 25 at the rear end of the piston guide toward the piston. The rear end of the piston is provided with a rearwardly extending ejector pin 48 (FIG. 2), and as the cartridge holder 25 approaches the piston, the ejector pin 48 moves into the cartridge bore of the cartridge holder to eject the cartridge as shown in FIG. 3. The housing 11 is provided with a breech opening 49 (see also FIG. 5) which is closed by the piston guide when the tool is in the ready-to-fire position of FIG. 1 but which exposes the rear or breech end of the cartridge holder when the piston guide is in the extended position of FIG. 3. The ejected spent cartridge is therefore free to fall through the breech opening 49 and out of the tool.

The tool can be reloaded with a fresh cartridge when the piston guide is in the position of FIG. 3 by inserting the cartridge through the breech opening 49 into the cartridge holder. The forward end of the cartridge will push the ejector pin 48 on the piston forwardly until the rim of the cartridge is seated in the rim portion 30 of the cartridge bore. Relatively free forward movement of the piston is permitted in order to minimize crushing of the crimped end of the cartridge by an enlarged annular recess 51 (FIG. 6) in the bore of the guide tube adjacent the forward end of the cartridge holder. This recess reduces the compressive force on the split ring 41 carried by the piston and thereby reduces the frictional force exerted by the split ring. The forward end of the recess provides an inwardly extending shoulder 52 which is engageable with the split ring after the cartridge has been inserted and which maintains the piston in the ready-to-fire position of FIG. 1. The shoulder 52 thus minimizes the likelihood that the piston will be jarred out of its ready-to-fire position by an improper hammer blow on the tool. However, when the cartridge is fired by a proper blow, the frictional force exerted by the split ring will be easily overcome by the explosive force of the cartridge.

The firing mechanism 47 includes an elongated firing pin 19 which is mounted for axial sliding movement in a generally cylindrical guide tube 53. The particular firing pin illustrated is a bolt which includes a head 54 and a shank 55 having a threaded end which receives a nut 56. The bolt is biased rearwardly away from the cartridge holder by a coil spring 57 within the guide tube.

Figure 6:
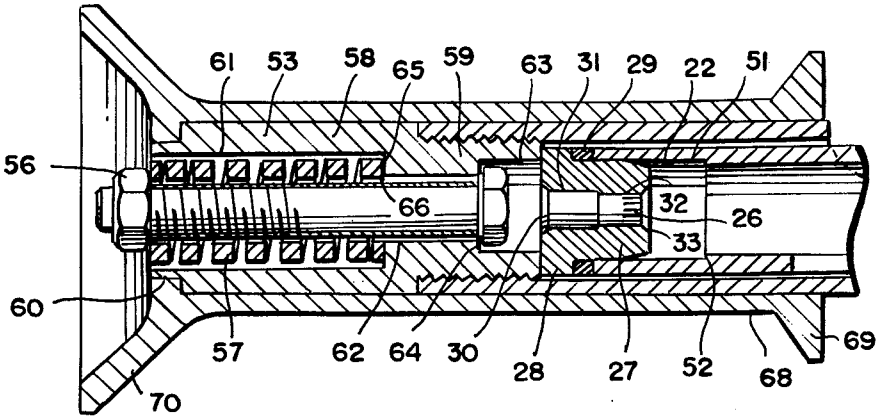
FIG. 6 is an enlarged fragmentary view of the rear end of the tool of FIG. 2.

As can be seen best in FIG. 6, the guide tube 53 includes a central portion 58 which has an outer diameter substantially the same as the outer diameter of the housing 11, a forward externally threaded end portion 59 of reduced diameter, and a rearward end portion 60 of reduced diameter. The threaded forward end portion 59 is threadedly engaged with internal threads on the rearward end of the housing 11. It will be understood, however, that the mechanical engagement of components is not limited to threads.

The firing pin extends through a central bore in the guide tube, and the bore includes a rear end portion 61 which is sized to accommodate the coil spring 57, a central portion 62 of smaller diameter, and a radially enlarged forward portion 63 which provides an abutment shoulder 64. The bolt head 54 engages the shoulder 64 to limit rearward movement of the bolt, and the spring 57 is compressed between the nut 56 and the shoulder 65 between the rear and central bores 61 and 62. The nut 56 can be tightened on the bolt to compress the spring to provide a desired preset force to minimize inadvertent firing of the cartridge. The preset force must be overcome before the bolt will move forwardly toward the cartridge.

A cylindrical spacer sleeve 66 surrounds the bolt shank between the bolt head 54 and the nut 56 and provides an accurate control on the preset spring force. The length of the spacer sleeve is selected so that the nut can be tightened against the rearward end of the spacer sleeve to provide the desired preset spring force. If a greater preset force is desired, a shorter spacer sleeve is used, and if a smaller preset force is desired, a longer spacer sleeve is used.

The spring preset can also be accomplished by the use of a more expensive shoulder bolt which would function just like a separate bolt and spacer.

The use of a conventional bolt as the firing pin reduces the cost of the firing pin and enables the preset force of the spring to be adjusted as desired. However, other rod-like members can be used. The use of a bolt and nut also provides two convenient detents, one of which is engageable with the abutment surface 64 of the firing pin guide to limit rearward movement of the firing pin and the other of which is engageable with the spring 57. Although the bolt is illustrated in the drawings with the bolt head 64 engaging the abutment surface 64 and in position to strike the cartridge, the bolt could be reversed so that the nut 56 engaged the abutment surface and the shank of the bolt was engageable with the cartridge.

The coil spring 57 normally maintains the bolt head 54 against the abutment surface 64 of the guide tube. The forward portion 59 of the guide tube extends forwardly beyond the bolt head and spaces the cartridge holder 25 forwardly of the bolt head to prevent inadvertent firing. The cartridge can be fired only if the rear end of the bolt is struck with sufficient force to overcome the preset force of the spring and to drive the bolt forwardly to strike the cartridge with sufficient force to fire the cartridge. In one specific embodiment of the invention, the strength of the spring and the preset force was such that an impact of 3 ft. lbs. was required to fire the tool.

The grip 14 includes a knurled central gripping portion 68, an outwardly flared forward portion 69, and an outwardly flared rearward portion 70 which provides a protective shroud surrounding the rear end of the firing pin. The shroud 70 terminates rearwardly of the firing pin and shields the firing pin from impact if the tool is dropped and protects the operator's hand from improperly directed hammer blows. The forward shroud prevents the operator's hand from slipping down into the breech area and enables the operator to hold the tool firmly against the workpiece. The grip can be adhesively or otherwise suitably secured to the outer surfaces of the firing pin guide 53 and the housing 11, and the rear end of the grip extends inwardly into engagement with the reduced diameter end portion 60 of the firing pin guide to prevent the grip from moving downwardly along the housing.

Figure 4:
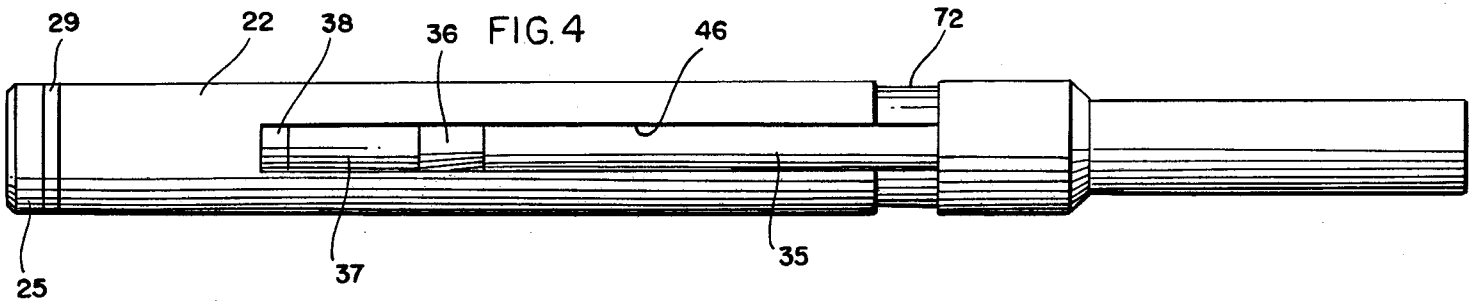
FIG. 4 is a plan view of the piston guide as would be seen along the line 4—4 of FIG. 3.

As can be seen best in FIGS. 3 and 4, the forward end of the guide tube 22 of the piston guide is provided with an annular recess 72 which is sized to accommodate the abutment spring 43. The tool is assembled by inserting the piston into the breech end of the piston guide before the cartridge holder 25 is secured to the piston guide. The abutment ring can then be positioned within the recess 72, and the diameter of the abutment ring can be reduced by pressing the inwardly turned ends 45 together sufficiently to permit the piston guide and abutment ring to be inserted into the forward end of the housing 11. The piston guide is so inserted before the firing mechanism 47 is secured to the rear end of the housing, and the piston guide can be moved rearwardly within the housing sufficiently to align the recess 72 in the piston guide with the recess 44 in the forward end of the housing. When the recesses are aligned, the abutment ring expands to position itself in the recess 44, and the piston guide is moved forwardly to permit the firing mechanism to be screwed into the rear end of the housing. Thereafter, the forward end of the firing pin guide tube prevents the piston guide from moving rearwardly enough to align the recesses 44 and 72. The indentation 11*a* in the housing prevents relative rotation of the piston guide and the housing and prevents the gases from the exploding cartridge from exhausting through the axial slot in the piston guide directly into the breech opening.

After the tool is loaded with a cartridge as previously described, the guide tube is moved rearwardly from the position illustrated in FIG. 3 to the ready-to-fire position of FIG. 1. The piston moves rearwardly with the guide tube by virtue of the engagement between the split ring 41 on the piston and the shoulder 52 within the piston guide tube. The fastener 18 is then inserted through the forward end of the muzzle portion 23 of the piston guide and moved rearwardly until the point of the fastener is flushed with the forward end as shown in FIG. 1. An elongated fastener of the type illustrated in FIG. 1 is conventionally equipped with a cylindrical eyelet or washer 73 for centering the forward end of the fastener within the muzzle and for frictionally retaining the fastener within the muzzle until the tool is fired.

While in the foregoing specification a detailed description of a specific embodiment of the invention was set forth for the purpose of illustration, it is to be understood that many of the details herein given may be varied considerably by those skilled in the art without departing from the spirit and scope of the invention.

We claim:

1. A hammer-activated power-actuated fastening tool having a tubular housing having front and rear ends, a tubular piston guide having a front muzzle end and a rear breech end slidably received within the housing and extending from the front end thereof and movable therewithin between a retracted, ready-to-fire position and an extended position, a piston slidably received within the piston guide and movable therewithin between a first or rearward position in which the piston is adjacent the breech end of the piston guide and a second or forward position spaced forwardly from the first position, and abutment means extending inwardly from the housing through a slot in the piston guide for limiting movement of the piston guide beyond its extended position, the abutment means being engageable with the piston as the piston guide is moved from its retracted position to its extended position to move the piston within the piston guide to its first position, the improvement comprising cartridge mounting means secured to the breech end of the piston guide for mounting a powder cartridge and firing means mounted on the housing rearwardly of the cartridge mounting means for firing a cartridge mounted within the cartridge mounting means, the firing means including an elongated firing pin having a front end engageable with a cartridge mounted within the cartridge mounting means when the piston guide is in its retracted position and a rear end engageable with a hammer, and a coil spring ensleeved over the firing pin and resiliently urging the front end of the firing pin away from the cartridge mounting means whereby a cartridge in the cartridge mounting means can be fired when the piston guide is in its retracted position by striking the rear end of the firing pin with sufficient force to move the firing pin forwardly against the bias of the spring and into engagement with the cartridge to fire the cartridge.

2. The tool of claim 1 in which the firing means includes a tubular firing pin guide secured to the housing, the firing pin comprising a bolt having a threaded shank and a head and a nut threadedly engaged with the shank, the shank being slidable axially within the firing pin guide, the coil spring being ensleeved over the shank of the bolt.

3. The tool of claim 2 including a tubular spacer ensleeved over the shank of the bolt between the head and the nut, the nut being threaded onto the shank so that the nut and the head engage the ends of the spacer whereby the spring is compressed and exerts a predetermined preset force which resists movement of the bolt toward the cartridge mounting means.

4. The tool of claim 1 including axially spaced front and rear detents on the rod, the firing pin guide including a first abutment engageable with the front detent on the rod for limiting rearward movement of the rod and a second abutment spaced rearwardly of the first abutment and engageable with the spring, the spring being positioned between the rear detent on the rod and the second abutment on the firing pin guide whereby forward movement of the rear detent toward the second abutment is resisted by the spring.

5. The tool of claim 1 in which the firing means includes a tubular firing pin guide secured to the housing and having a central bore, a front abutment surrounding the bore and a rear abutment surrounding the bore, the firing pin comprising a bolt having a threaded shank and a head and a nut threadedly engaged with the shank, the shank extending axially through the bore of the firing pin guide and one of the head and the nut being positioned forwardly of the front abutment and engageable therewith for limiting rearward movement of the bolt and the other of the head and the nut being positioned rearwardly of the rear abutment, the coil spring being ensleeved over the shank of the bolt between the rear of the abutment and said other of the head and nut whereby forward movement of the bolt is resisted by the spring means.

6. The tool of claim 5 including a tubular spacer ensleeved over the shank of the bolt between the head and the nut, the nut being threaded onto the shank so that the nut and the head engage the ends of the spacer whereby the spring is compressed and exerts a predetermined preset force which resists movement of the bolt toward the cartridge mounting means.

7. The tool of claim 5 in which the firing pin guide includes a front end portion extending forwardly from the front abutment and engageable with the cartridge mounting means for spacing the cartridge mounting means forwardly of the bolt until the bolt is struck with a hammer to fire the tool.

8. The tool of claim 6 in which the cartridge mounting means comprises a cylindrical plug secured to the end of the breech end of the piston guide and having a bore therethrough for receiving and holding a cartridge.

9. The tool of claim 1 in which the piston guide has a cylindrical inner surface for guiding the piston and a radially enlarged annular recess in the inner surface adjacent the cartridge mounting member, friction means on the piston adjacent the rear end thereof for frictionally engaging the inner surface of the piston guide to provide a frictional retention force for restraining axial sliding movement of the piston within the piston guide, the piston being relatively freely axially movable when the friction means is positioned within the annular recess whereby the piston can be moved forwardly by a cartridge when the cartridge is inserted into the cartridge mounting means.

10. The tool of claim 9 in which the friction means comprises an expandable split ring positioned within an annular groove within the piston.

11. The tool of claim 1 in which the abutment means comprises a ring between the housing and the piston guide and encircling the piston guide, the ring having an end portion which extends radially inwardly through the slot in the piston guide.

12. The tool of claim 11 in which the inside of the housing is provided with an annular recess which receives the ring and prevents axial movement of the ring within the housing.

13. The tool of claim 12 in which the housing includes a detent engageable with the ring to prevent rotation of the ring within the housing.

14. The tool of claim 1 including an abutment mounted on the firing pin adjacent the rear end thereof, the spring engaging the abutment and urging the abutment and the firing pin rearwardly, the abutment being axially adjustable on the firing pin.

15. A hammer-activated powder-actuated fastening tool having a tubular housing having front and rear ends, a tubular piston guide having a front muzzle end and a rear breech end slidably received within the housing and extending from the front end thereof and movable therewithin between a retracted, ready-to-fire position and an extended position, a piston slidably received within the piston guide and movable therewithin between a first or rearward position in which the piston is adjacent the breech end of the piston guide and a second or forward position spaced forwardly from the first position, and abutment means extending inwardly from the housing through a slot in the piston guide for limiting movement of the piston guide beyond its extended position, the abutment means being engageable with the piston as the piston guide is moved from its retracted position to its extended position to move the piston within the piston guide to its first position, the improvement comprising cartridge mounting means secured to the breech end of the piston guide for mounting a powder cartridge and firing means mounted on the housing rearwardly of the cartridge mounting means for firing a cartridge mounted within the cartridge mounting means, the firing means including a firing pin having a front end engageable with a cartridge mounted within the cartridge mounting means when the piston guide is in its retracted position and a rear end engageable with a hammer, the firing pin comprising a bolt having a threaded shank and a head and a nut threadedly engaged with the shank, and spring means for resiliently urging the front end of the firing pin away from the cartridge mounting means whereby a cartridge in the cartridge mounting means can be fired when the piston guide is in its retracted position by striking the rear end of the firing pin with sufficient force to move the firing pin forwardly against the bias of the spring means and into engagement with the cartridge to fire the cartridge.

16. A hammer-activated powder-actuated fastening tool having a tubular housing having front and rear ends, a tubular piston guide having a front muzzle end and a rear breech end slidably received within the housing and extending from the front end thereof and movable therewithin between a retracted ready-to-fire position and an extended position, a piston slidably received within the piston guide and movable therewithin between a first or rearward guide and a second or forward position spaced forwardly from the first position, and abutment means extending inwardly from the housing through a slot in the piston guide for limiting movement of the piston guide beyond its extended position, the abutment means being engageable with the piston as the piston guide is moved from its retracted position to its extended position to move the piston within the piston guide to its first position, the improvement comprising cartridge mounting means secured to the breech end of the piston guide for mounting a powder cartridge and firing means mounted on the housing rearwardly of the cartridge mounting means, the firing means including a firing pin having a front end engageable with a cartridge mounted within the cartridge mounting means when the piston guide is in its retracted position and a rear end engageable with a hammer, and spring means for resiliently urging the front end of the firing pin away from the cartridge mounting means whereby a cartridge in the cartridge mounting means can be fired when the piston guide is in its retracted position by striking the rear end of the firing pin with sufficient force to move the firing pin forwardly against the bias of the spring means and into engagement with the cartridge to fire the cartridge, the piston guide having a cylindrical inner surface for guiding the piston and a radially enlarged annular recess in the inner surface adjacent the cartridge mounting member, friction means on the piston adjacent the rear end thereof for frictionally engaging the inner surface of the piston guide to provide a frictional retention force for restraining axial sliding movement of the piston within the piston guide, the piston being relatively freely axially movable when the friction means is positioned within the annular recess whereby the piston can be moved forwardly by a cartridge when the cartridge is inserted into the cartridge mounting means.

* * * * *